US008939231B2

(12) United States Patent
Roberts et al.

(10) Patent No.: US 8,939,231 B2
(45) Date of Patent: Jan. 27, 2015

(54) REAR HANDLE

(75) Inventors: Ana-Maria Roberts, Idstein (DE); Andreas Friedrich, Limburg (DE)

(73) Assignee: Black & Decker Inc., Newark, DE (US)

( * ) Notice: Subject to any disclaimer, the term of this patent is extended or adjusted under 35 U.S.C. 154(b) by 694 days.

(21) Appl. No.: 13/196,978

(22) Filed: Aug. 3, 2011

(65) Prior Publication Data

US 2012/0031639 A1 Feb. 9, 2012

(30) Foreign Application Priority Data

Aug. 5, 2010 (GB) ..... 1013175.3

(51) Int. Cl.
*B25D 17/00* (2006.01)
*B25D 17/04* (2006.01)

(52) U.S. Cl.
CPC ..... *B25D 17/043* (2013.01); *B25D 2250/121* (2013.01); *B25D 2250/371* (2013.01)
USPC ..... 173/162.2; 173/162.1; 173/79

(58) Field of Classification Search
CPC ..... B25D 17/24; B25D 17/043; B25D 2217/0019; B23B 2250/16
USPC ..... 173/162.1, 162.2, 79, 47, 210, 211
See application file for complete search history.

(56) References Cited

U.S. PATENT DOCUMENTS

| | | | | |
|---|---|---|---|---|
| 5,697,456 | A * | 12/1997 | Radle et al. | 173/162.2 |
| 7,591,325 | B2 * | 9/2009 | Robieu | 173/162.2 |
| 2010/0186979 | A1 * | 7/2010 | Krauter et al. | 173/162.2 |

* cited by examiner

*Primary Examiner* — Stephen F Gerrity
*Assistant Examiner* — Joy N Sanders
(74) *Attorney, Agent, or Firm* — Gabriel A. Haboubi

(57) ABSTRACT

A power tool, including a housing and a handle having two ends. The first end of the handle being moveably mounted to the housing via a first mounting assembly and the second end being moveably mounted to the housing via a second mounting assembly. One part of the first mounting assembly including a sleeve and the other part including a rod mounted in an axially slideable manner in the sleeve. A biasing mechanism connected between the two parts. One part of the second mounting assembly including a support and the other part including a pin located in the support which is capable of being rotated in the support to enable the second end of the handle to rotate relative to the housing and to move linearly in the support to enable the second end of the handle to move linearly relative to the housing.

14 Claims, 6 Drawing Sheets

REAR HANDLE

CROSS-REFERENCE TO RELATED APPLICATIONS

This application claims priority, under 35 U.S.C. §119(a)-(d), to UK Patent Application No. GB 10 131 75.3 filed Aug. 5, 2010, the contents of which is incorporated herein by reference in its entirety. The disclosure of GB 2456805 which was filed on Jul. 29, 2009 is also incorporated herein by reference in its entirety.

FIELD OF THE INVENTION

The present invention relates to a handle for a power tool, in particular for a hammer drill, and in particular, to a mounting assembly for a rear handle on a hammer drill which reduces the amount of vibration transmitted to the handle.

BACKGROUND OF THE INVENTION

Power tools of all types comprise a body attached to which are handles by which an operator can support the tool. Vibrations are generated in the body during the operation of such tools which are transferred to the handles. It is desirable to minimize the amount of transfer.

A hammer drill can operate in one or more of the following modes of operation; hammer only mode, drill only mode and combined hammer and drill mode. EP1157788 discloses such a hammer. During the operation of such hammers, a considerable amount of vibration can be generated. The vibration is caused by the operation of the rotary drive mechanisms and/or the hammer mechanisms, depending on the mode of operation of the hammer drill, combined with the vibratory forces applied to and experienced by the cutting tool, such as a drill bit or chisel when it is being used on a work piece. These vibrations are transferred to the body of the hammer drill, which in turn are transferred to a rear handle being used by the operator to support the hammer drill. The transfer of vibration to the rear handle from the body, and subsequently to the operator's hand can not only be painful but can result in injury, particularly when the hammer drill is used over long periods of time. It is therefore desirable to minimise the amount of vibration transferred from the body to the rear handle.

One solution is to moveably mount the rear handle on the body of the hammer drill to allow relative movement between the two and to locate a vibration dampening mechanism between the body and the rear handle to minimise the amount of vibration transferred to the rear handle from the body.

GB2456805 describes such a vibration dampening mechanism for a hammer drill with reference to FIGS. 22 to 32 by which the amount of vibration transferred to the rear handle from the body is reduced. The rear handle 294 (using the same reference numbers as GB2456805) is connected via an upper mounting assembly 308, which enables the upper part of the handle 294 to slide relative to the upper part of the housing 290, and a lower mounting assembly 310, which enables a pivoting movement of the lower part of the handle relative to the lower part of the housing. Both the upper mounting assembly 308 and the lower mounting assembly 310 comprise vibration dampening mechanisms which reduce the amount of vibration transferred to the rear handle 294 from the housing 290.

BRIEF SUMMARY OF THE INVENTION

Accordingly there is provided a power tool comprising:

a housing;

a handle having two ends, the first end being moveably mounted to the housing via a first mounting assembly, the second end being moveably mounted to the housing via a second mounting assembly;

wherein the first mounting assembly comprises:

a first part mounted on the housing and a second part mounted on the first end of the handle, one part comprising a sleeve, the other part comprising a rod mounted in an axially slideable manner in the sleeve to enable the first end of the handle to slide towards or away from the housing; and a biasing mechanism connected between the two parts which biases the first end of the handle away from the housing;

wherein the second mounting assembly comprises:

a third part mounted on the body and a fourth part mounted on the second end of the handle, one part comprising a support, the other part comprising a pin located in the support which is capable of being rotated in the support to enable the second end of the handle to rotate relative to the housing and to move linearly in the support to enable the second end of the handle to move linearly relative to the housing;

characterized in that the support comprises a passage in which the pin is located, the pin being capable of freely moving within the passage either rotationally to enable the second end of the handle to rotate relative to the housing or linearly to enable the second end of the handle to move linearly relative to the housing.

Preferably the power tool is a hammer drill and the handle is a rear handle.

BRIEF DESCRIPTION OF THE DRAWINGS

Two embodiments of the present invention will now be described with reference to drawings of which.

DETAILED DESCRIPTION OF THE INVENTION

Figure 1:
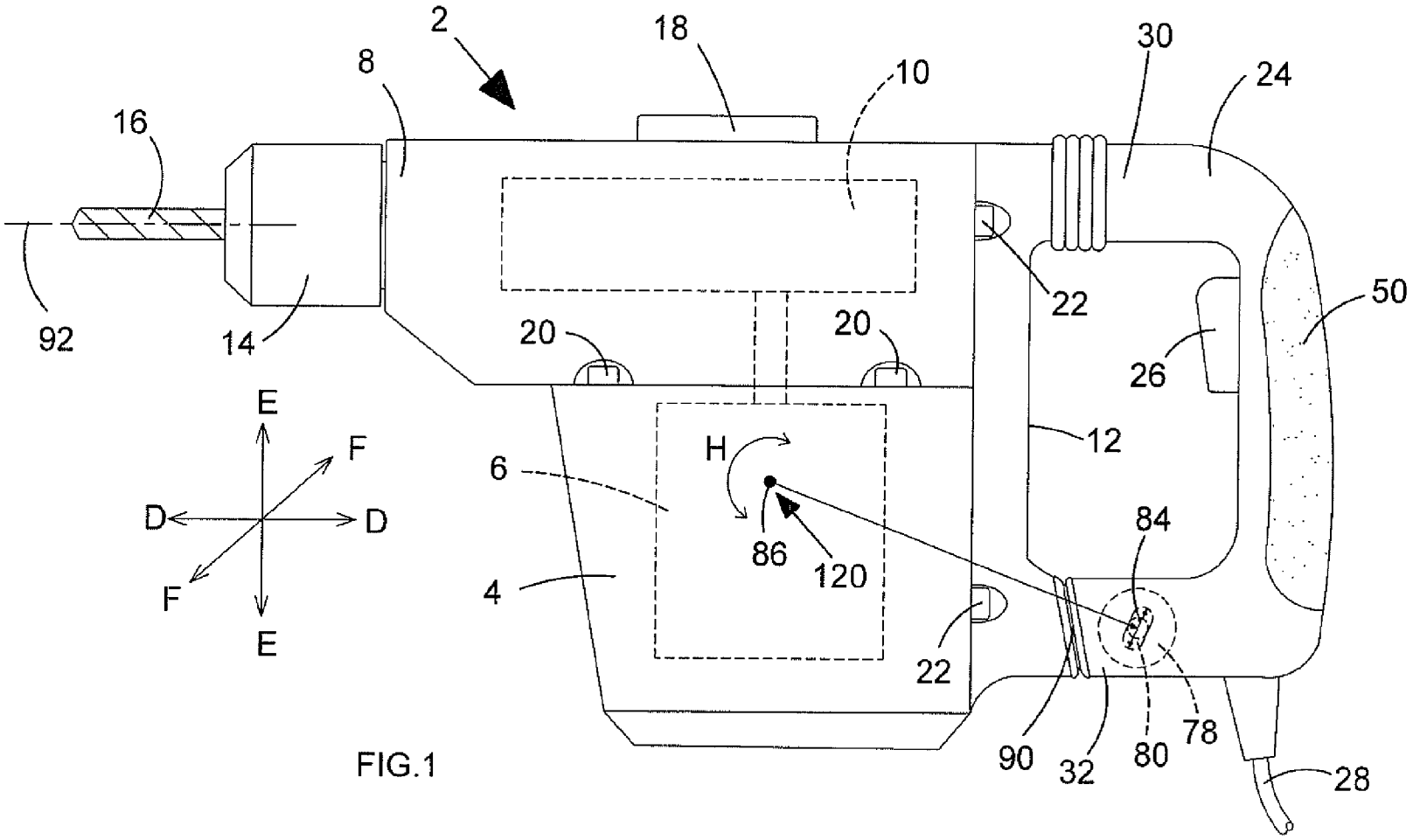
FIG. 1 shows a sketch of a side view of a hammer drill.

Referring to FIG. 1, a hammer drill comprises a main housing 2 which comprises a motor housing 4, in which is mounted an electric motor 6, a gear housing 8 in which is mounted a rotary drive and hammer mechanism 10, and a rear housing 12. The motor housing 4 is connected to the gear housing using bolts 20. Similarly, the rear housing 12 is attached to both of the motor housing 4 and gear housing 8 using bolts 22. A tool holder 14 is mounted on the front of the gear housing 8 which is capable of holding a cutting tool 16, such as a drill bit. The motor 6 rotatingly and/or reciprocatingly drives the cutting tool 16 via the rotary drive and/or hammer mechanism 10. The hammer drill can operate in three modes of operation, namely hammer only mode, drill only mode and combined hammer and drill mode. A mode change knob 18 is rotatably mounted on the top of the gear housing 8. Rotation of the knob 18 to predetermined angular positions activates or deactivates the rotary drive and/or hammer mechanism 10 to adjust the mode of operation of the hammer drill.

A rear handle 24 is moveably mounted to the rear housing 12 as will be described in more detail below. The rear handle 24 is manufactured from a plastic clam shell which provides a hollow cavity inside of the handle in which component parts of the hammer can located. A trigger switch 26 is mounted on the rear handle 24. An electric cable 28 enters the base of the rear handle 24 and connects to the electric motor via the trigger switch 26. Depression of the trigger switch 26 activates the motor. A rubber soft grip 50 is moulded onto the rear of the rear handle 24 in well known manner.

The first embodiment of the present invention will now be described with reference to FIGS. 2 to 6.

The rear handle is mounted to the rear housing 12 at its two ends 30, 32. The top end 30 is mounted to the rear housing 12 via an upper mounting assembly 34. The upper mounting assembly 34 allows the top end 30 of the housing 12 to move towards or away from (Arrow D) the rear housing 12 over a large range of movement, whilst allowing limited movement in the directions of Arrows E and F relative to rear housing 12. The lower end 32 is mounted to the rear housing 12 via a lower mounting assembly 36. The lower mounting assembly 36 allows the lower end 32 of the handle to pivot (Arrow G—see FIG. 4) about a horizontal axis 58 relative to the rear housing 12, whilst allowing limited linear movement in the directions of Arrows D and E.

The lower mounting assembly 36 comprises a metal pin 70 of circular cross section which is mounted inside the lower end 32 of the handle. The pin 70 has a longitudinal axis 58. The pin 70 extends side ways (generally in the direction of Arrow F) relative to the handle 24. The pin 70 is rigidly connected to the side walls 72 of the lower end 32 of the handle 24 and traverses the cavity inside of the handle 24.

The upper mounting assembly 34 will now be described with reference to FIGS. 2 and 6. The upper mounting assembly 34 comprises a metal rod 38 which is rigidly attached to the rear housing 12 using a bolt 40. The bolt 40 passes through a hole 46 in the rear housing 12 and through the length of the rod 38. The head 42 of the bolt 40 abuts the rear housing 12. A nut 44 is screwed on the end of the bolt 40 and sandwiches the rod 38 and the part of the rear housing 12 with the aperture 46 between the head 42 of the bolt and the nut 44 thus locking the rod 38 to the rear housing 12.

Figure 2:
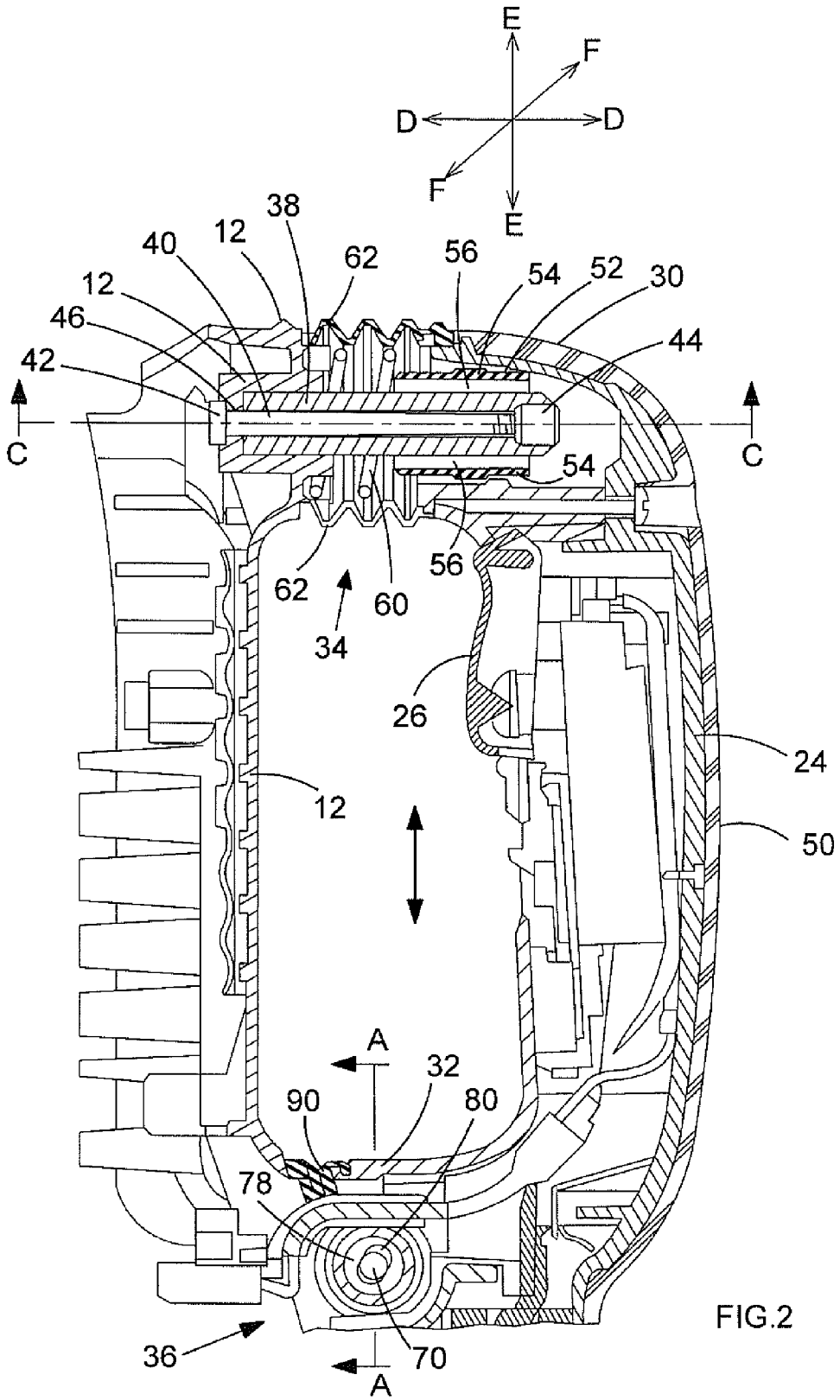
FIG. 2 shows a vertical cross sectional view of the rear handle of the first embodiment of the present invention.
Figure 3:
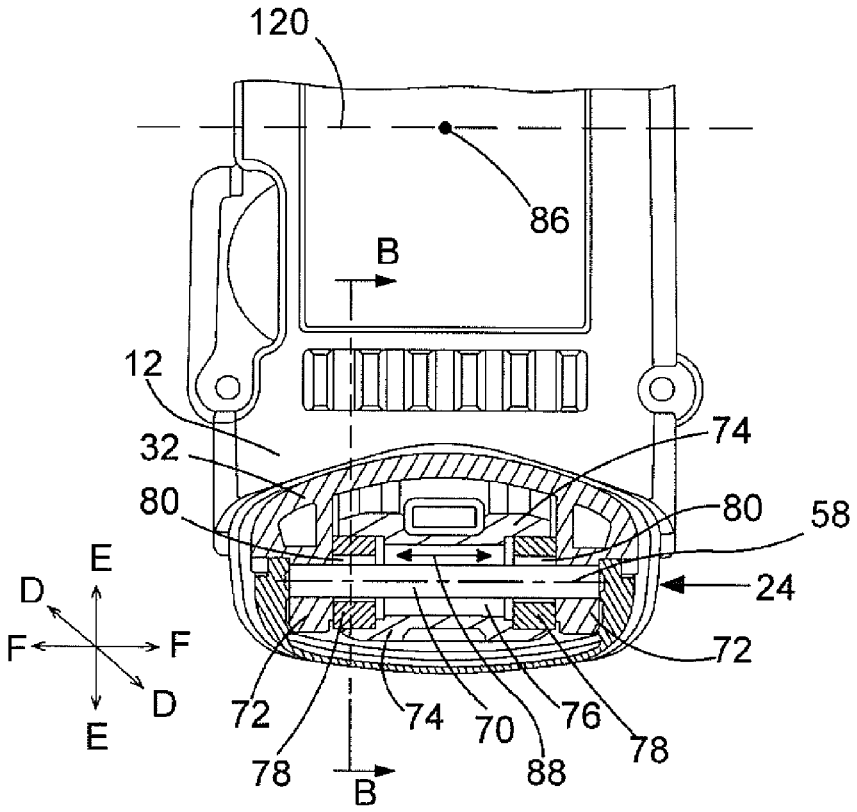
FIG. 3 shows a vertical cross sectional view of the lower section of the rear handle in the directions of Arrows A in FIG. 2.
Figure 4:
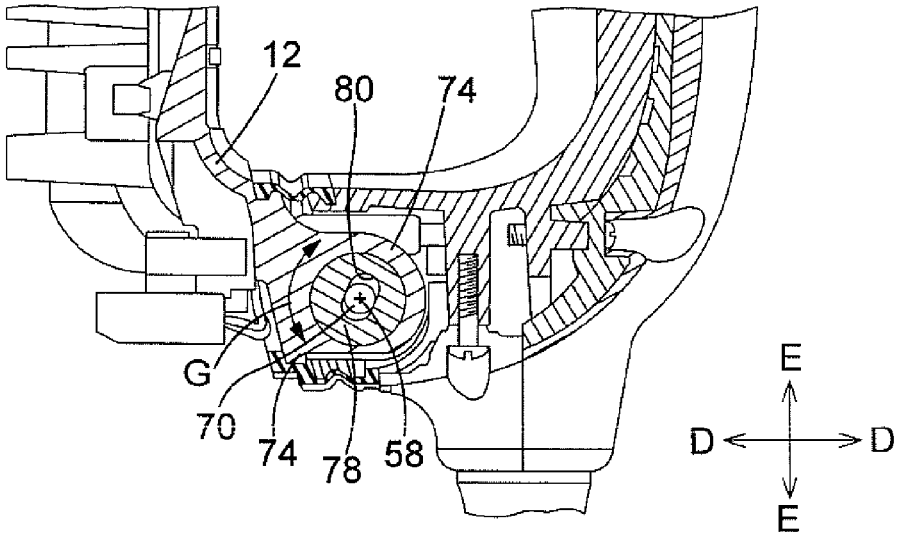
FIG. 4 shows a vertical cross sectional view of the lower section of the rear handle in the directions of Arrows B in FIG. 3.
Figure 5A:
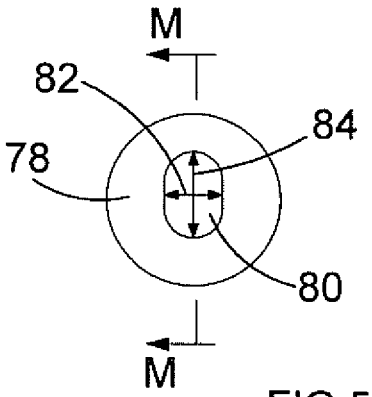
FIG. 5A shows a side view of the insert and FIG. 5B shows a cross section view of the insert in the direction of Arrow M in FIG. 5A.
Figure 5B:
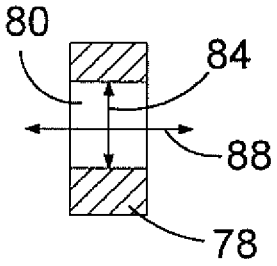
Figure 6:
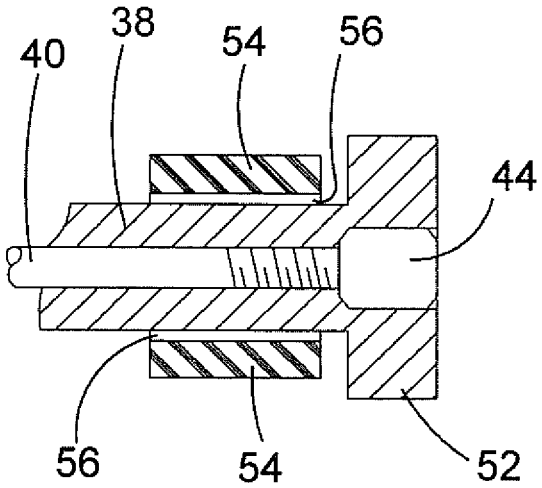
FIG. 6 shows a horizontal part cross sectional view of the rod and sleeve of the upper mounting assembly in the directions of Arrows C in FIG. 2.

The free end of the rod 38 comprises a rectangular portion 52, the height (vertically) of which is the same as the rod 38 (as seen in FIG. 2), but the width (horizontally) of which is greater than the rod 38 (see FIG. 6).

Rigidly mounted inside the cavity at the top end 30 of the rear handle 24 is a plastic tubular sleeve 54. The shaft of the rod 38 passes through the length of the tubular aperture 56 formed by the sleeve 54. The length of the shaft of the rod 38 is greater than the length of the sleeve 54. The dimensions of the cross section area of the tubular aperture 36 of the sleeve are slightly greater than the dimensions of the cross section area of the rod 38 so that a small gap is formed between the outer surface of the shaft of the rod 38 and the inner wall of the tubular aperture 56. The rectangular portion 52 of the rod 38 locates at one end of the sleeve 54. The width of the rectangular end of the rod 38 is greater than the width of the tubular aperture 56 and the sleeve 54 (see FIG. 6). As such, it is too wide for it to pass through the tubular aperture 56. The other end of the rod 38 which is attached to the rear housing is located at the other end of the sleeve and is prevented from entering the tubular aperture 56 by the rear housing 12. The rod 38 can freely slide in an axial direction (Arrow D) within the sleeve 54, the range of axial movement being limited at one end of the range by the rear housing 12 engaging with one end of the sleeve 54 and at the other end of the range by the rectangular portion 52 engaging with the other end of the sleeve 54. As the dimensions of the cross section area of the tubular aperture 36 of the sleeve are slightly greater than the dimensions of the cross section area of the rod 38 to produce a small gap between the outer surface of the shaft of the rod 38 and the inner wall of the tubular aperture 56, limited movement of the rod 38 inside of the sleeve is allowed in the directions of Arrows E and F relative to rear housing 12.

Connected between the rear housing 12 and top end 30 of the rear handle 24 is a helical spring 60 which surrounds the rod 38. The spring biases the top end 30 of the rear handle 24 away from the rear housing 12. When the spring 60 biases the top end of the rear handle away by the maximum amount, the rectangular portion 52 engages with the end of the sleeve 54, preventing further movement of the top end 30 of the handle 24 away from the rear housing 12. The spring 60 is under a small compression force in this state. When the top end 30 of the rear handle is moved towards the rear housing 12 against the biasing force of the spring 60 by the application of an external force, the spring 60 becomes further compressed and shortens in length as the rod 38 axially slides within the sleeve 54 until the rear housing engages with the other end of the sleeve 54. When the external force is removed, the top end 30 of the rear handle 24 moves away from the rear housing due to the biasing force of the spring 60, the rod 38 axially sliding within the sleeve 54 until the rectangular portion 52 engages the end of the sleeve 54. The spring 60 also applies a biasing force on the rod 38 in a direction of Arrows E and F, urging the rod 38 to a central position within the sleeve 54. As such, when no external forces are applied to the rear handle 24, the spring 60 also locates the rod 38 centrally within the tubular aperture 56 so that a gap is formed around the whole of the outer surface of the rod and the inner wall of the sleeve 54. Movement of the rod in directions of Arrows E or F causes the rod 38 to move towards an inner wall of the tubular aperture 56 against a side way biasing force generated by the spring 60.

A set of bellows 62 connects between the rear housing 12 and the top 30 of the handle and surrounds the rod 38 and spring 60.

The lower mounting assembly 36 will now be described with reference to FIGS. 2 to 5.

The lower mounting assembly 36 comprises a metal pin 70 of circular cross section which is mounted inside the lower end 32 of the handle. The pin 70 has a longitudinal axis 58. The pin 70 extends side ways (generally in the direction of Arrow F) relative to the handle 24. The pin 70 is rigidly connected to the side walls 72 of the lower end 32 of the handle 24 and traverses the cavity inside of the handle 24.

The rear housing 12 comprises a projection 74 which extends rearwardly and projects into the cavity of the handle 24 at the lower end of the handle 24 in the vicinity of the pin 70. Formed through projection is a hollow passage 76. The hollow passage 76 similarly extends side ways (in the direction of Arrow F). The pin 70 passes through the length of the hollow passage 76, each end of the pin 70 extending beyond an end of the hollow passage 76 and connecting to the side wall 72 of the handle 24. The cross sectional area of the hollow passage 76 is greater than the cross sectional area of the pin 70, allowing the pin 70 to move sideways (in the direction of Arrows D and E) inside of the passageway 76, as well as being able to feely pivot (in the direction of Arrow G) within the hollow passage 76.

Located inside each end of the hollow passage 76 is an insert 78. Each insert 78 is of identical size and is rigidly connected to the inner wall of the hollow passage 76 to prevent movement of the insert 78 relative to the projection 74. An aperture 80, with an oval cross section, is formed through each insert 78 (see FIGS. 5A and 5B) and which extends in the same direction as the hollow passage 76. The pin 70 passes through each of the apertures 80. The two apertures 80 are aligned with each other inside of the projection 74.

The width 82 of the aperture 80 is marginally greater that the diameter of the pin 70. The length 84 of the aperture is twice the size of the diameter of the pin 70. As such, the pin can side sideways in a lengthwise direction 84 in the aperture 80.

The pin 70 is prevented from sliding sideways 88 through the aperture 80 by the side walls 72 of the lower end 32 of the handle 24, to which the pin 70 is rigidly attached, abutting directly against the sides of the inserts 78.

The hammer drill (excluding the rear handle 24) has a centre of gravity 86. A centre of gravity axis 120 passes through the centre of gravity. The centre of gravity axis is horizontal and extends width ways in the direction of Arrow F. The inserts are mounted in side the hollow passage 76 with aperture 80 orientated so that the lengthwise direction 84 of the aperture 80 extends tangentially to a circle (with radius R) centered on the centre of gravity axis 120 of the hammer drill (see FIG. 1) in a plane which extends in the directions of Arrows D and E (It should be noted that a plane which extends in the directions of Arrows D and E is a lengthwise vertical plane. A plane which extends in the directions of Arrows F and E is width way vertical plane).

When no force is applied to the rear handle 24 by an operator, the pin 70 is biased to the centre, in the lengthwise direction 84, of the aperture 80 of each insert 80, with equal space within the aperture 80 being left on either side of the pin 70 in the lengthwise direction 84. The biasing force acting on the pin 70 is generated by the spring 60 in the upper mounting assembly 34 which urges the pin 70 to the central position. Sliding movement of the pin 70 in the aperture, in the lengthwise direction 84, towards either of the ends of the oval aperture, is against the biasing force of the spring 60.

A set of bellows 90 connects between the rear housing 12 and the lower end 32 of the handle 24.

During use, the operator supports the hammer drill using the rear handle 24. When the operator places the cutting tool against a work piece, the operator applies a pressure to the rear handle 24, causing the rear handle 24 to move towards the rear housing 12 of the hammer. The top end 30 moves towards the rear housing 12 by the rod 38 axially sliding within the sleeve 54 against the biasing force of the spring 60, reducing the length of the spring 60 as it becomes compressed. The lower end 32 pivots about the pin 70. Depression of the trigger 26 activates the motor 6 which drives the cutting tool 16.

During the operation of the hammer, vibrations are generated by the operation of the motor 6 and the rotary drive and hammer mechanism 10. These vibrations are transferred to the rear housing 12. Significant vibrations are generated in two directions in particular. The first direction is in a linear direction (Arrow D) parallel to a longitudinal axis 92 of the cutting tool 16. The second direction is in a circular direction (Arrow H) about the centre of gravity axis 120 of the hammer. This is caused by the centre of gravity 86 being located away from the longitudinal axis 92 of the cutting tool 16, in this case, below the longitudinal axis 92.

Vibrations in the first direction are mainly absorbed by the upper mounting assembly 34, and by the spring 60 in particular. As the rear housing 12 vibrates in the first direction, the rod 38 can axially slide in and out of the sleeve 54 under the influence of the vibrations, the spring 60 expanding and compressing as it does so. The dampening action of the spring 60 results in a reduction in the amount of vibration transferred to the rear handle 24 from the rear housing 12. As the rod 38 axially slides in and out of the sleeve 54 under the influence of the vibrations, the rear handle 12 pivots about the pin 70 in the lower mounting assembly 36 as it engages with the side walls of the oval aperture 80 as the pin 70 is urged by the vibrations in the first direction to move in a direction parallel to the longitudinal axis 92 of the cutting tool 16.

If the operator applies more pressure to the rear handle 24, the spring 60 becomes more compressed, thus transferring the additional force to the rear housing 12 of the hammer drill. However, its compression and expansion due to the vibration continues to result in a reduction of vibration being transferred to the rear handle 24 from the rear housing 12.

Vibrations in the second direction result in a twisting movement of the housing 2, motor 6 and the rotary drive and hammer mechanism 10 about the centre of gravity axis 120 (Arrow H). These vibrations are mainly absorbed by the lower mounting assembly 36. As the pin 70 is located in the oval slot 80 of the insert 78 which is orientated so that the lengthwise direction 84 of the aperture 80 extends tangentially to a circle centered on the centre of gravity axis 120 which extends in a lengthwise vertical plane, the pin 70 can slide tangentially relative to the centre of gravity axis 120, allowing housing 2, motor 6 and the rotary drive and hammer mechanism 10 to twist about the centre of gravity axis 120 relative to the rear handle 24. This twisting movement is then damped due to the action of the spring 60 in the upper mounting mechanism 32 which biases the pin 70 to the centre of the oval slot 80. The twisting movement of the housing 2, motor 6 and the rotary drive and hammer mechanism 10 about the centre of gravity axis 120 relative to the rear handle 24 is accommodated by the top mounting assembly 34 by the gap formed between the outer surface of the rod 38 and the inner wall of the sleeve 54. As the rod 38 being urged to a central position within the sleeve 54 by the spring 60, when vibrations in the second direction are applied, the rod 38 can move sideways (Arrow E) within the sleeve 54. The spring 60, which biases the rod 38 centrally within the tubular aperture 36, also dampens the movement of the rod 38 in the sleeve 54.

A second embodiment of the invention will now be described with reference to FIGS. 7 and 8. Where the same features shown in the second embodiment are present in the first embodiment, the same reference numbers have been used.

The upper mounting assembly 34 in the second embodiment is the same as the upper mounting assembly in the first embodiment. The lower mounting assembly 36 in the second embodiment is the same as the lower mounting assembly in the first embodiment except for the shape of the cross section of the aperture 80' through the insert 78. Everything else is the same.

The shape of the cross section of the aperture 80' is semicircular. The cross section has a flat wall 100 and a circular curved wall 102. The radius 104 of the curved wall 102 is twice the diameter of the pin 70 which passes through it.

The hammer drill (excluding the rear handle 24) has a centre of gravity 86 with a horizontal width ways centre of gravity axis 120 passing through it. The inserts 78 with the semi-circular apertures 80' are mounted in side the hollow passage 76 with aperture 80' orientated so that the flat wall 100 of the aperture 80' extends (Arrows N) tangentially to a circle (with radius R) centered on the centre of gravity axis 120 of the hammer drill in a lengthwise vertical plane in the directions of Arrows D and E (see FIG. 8 which shows a schematic diagram).

Figure 7:
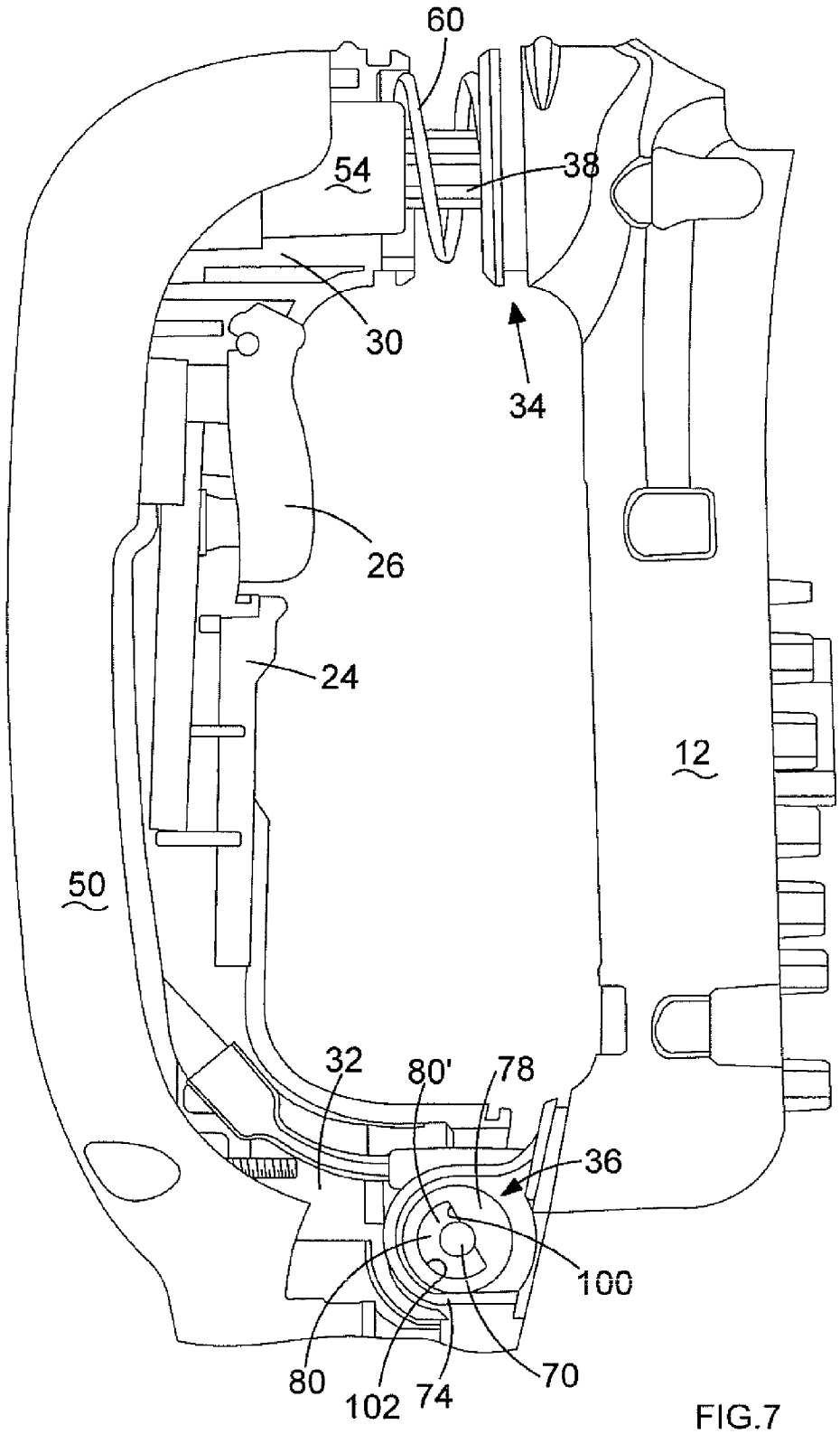
FIG. 7 shows a vertical cross sectional view of the rear handle of the second embodiment of the present invention.
Figure 8:
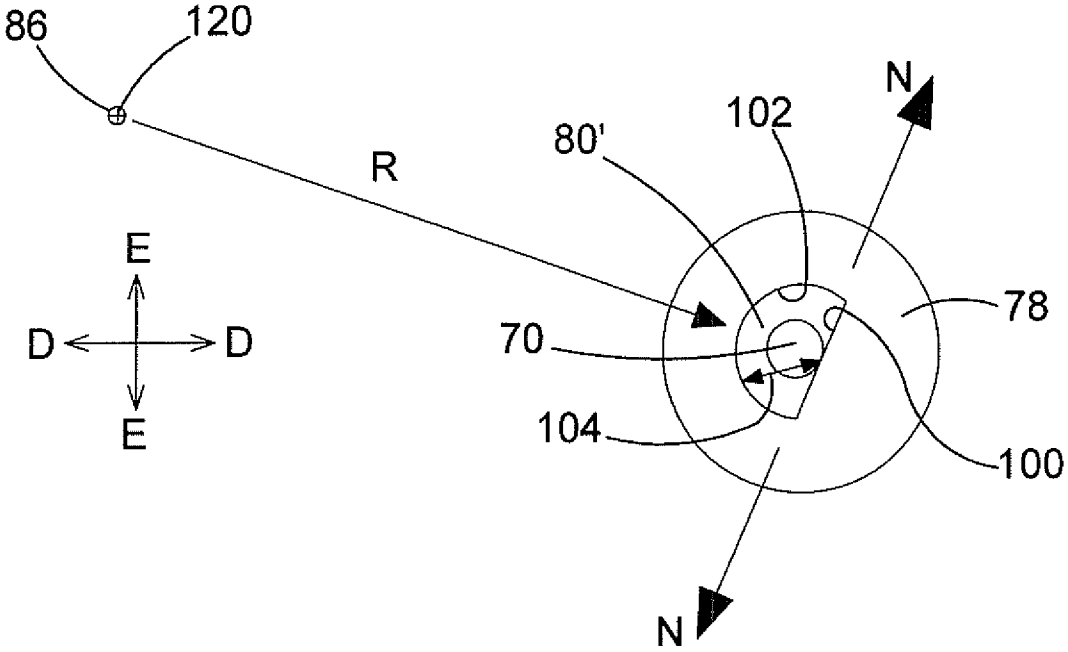
FIG. 8 shows a side view of the insert according to the second embodiment.

When no force is applied to the rear handle 24 by an operator, the pin 70 is biased by the spring 60 against the flat wall 100 of the aperture 80' at he centre of the flat wall 100, with equal space within the aperture 80' being left on either side of the pin 70 in the direction of the flat wall 100 as shown in FIGS. 7 and 8. Movement of the pin 70 in the aperture 80', in any direction from the central position against the flat wall 100 is against the biasing force of the spring 60.

Vibrations in the second direction result in a twisting movement of the housing 2, motor 6 and the rotary drive and hammer mechanism 10 about the centre of gravity axis 120. As the pin 70 is located in the semi-circular slot 80' of the insert 78 which is orientated so that the flat wall 100 of the aperture 80' extends (Arrow N) tangentially to a circle centered on the centre of gravity axis 120 in a lengthwise vertical plane, the pin 70 can slide tangentially relative to the centre of gravity axis 120 along the flat wall 100, allowing housing 2, motor 6 and the rotary drive and hammer mechanism 10 to twist about the centre of gravity axis 120 relative to the rear handle 24. This twisting movement is then damped due to the action of the spring 60 in the upper mounting mechanism 32 which biases the pin 70 against and to the centre of the flat wall 100.

However, the pin 70 is also allowed to move within the aperture away from the flat wall 100 towards the circular wall 102 against the biasing force of the spring 60. This assists in the in dampening vibrations in the first direction as, in addition to the rear handle 12 pivoting about the pin 70 in the lower mounting assembly 36 when it is engaged with either the flat wall 100 or semi circular wall 102 (or both) of the aperture 80', it can move linearly sideways within the aperture 80' allowing a limited linear movement of the lower end 32 of the handle 24 relative to the rear housing 12.

Whilst the two embodiments described relate to hammer drills, it will be appreciated by the reader that the invention as claimed could relate to a range of different types of power tools.

The invention claimed is:

1. A power tool comprising:

a housing;

a handle having a first end opposite a second end, the first end being moveably mounted to the housing via a first mounting assembly, and the second end being moveably mounted to the housing via a second mounting assembly, such that the first mounting assembly is located at an opposite end of the handle from the second mounting assembly;

wherein the first mounting assembly comprises:

a first part mounted on the housing and a second part mounted on the first end of the handle, one of the first and second parts comprising a sleeve, the other of the first and second parts comprising a rod mounted in an axially slideable manner in the sleeve to enable the first end of the handle to slide towards or away from the housing; and a biasing mechanism connected between the two parts which biases the first end of the handle away from the housing;

wherein the second mounting assembly comprises:

a third part mounted on the housing and a fourth part mounted on the second end of the handle, one of the third and fourth parts comprising a support, the other of the third and fourth parts comprising a pin located in the support which is capable of being rotated in the support to enable the second end of the handle to rotate relative to the housing and to move linearly in the support to enable the second end of the handle to move linearly relative to the housing;

wherein the support comprises a passage in which the pin is located, the pin being capable of freely moving within the passage either rotationally to enable the second end of the handle to rotate relative to the housing or linearly to enable the second end of the handle to move linearly relative to the housing; and wherein the rod of the first mounting assembly can further move in the sleeve in a direction which is perpendicular to the direction of movement of the rod when it axially slides in the sleeve.

2. The power tool of claim 1, wherein the biasing mechanism of the first mounting assembly also biases the pin of the second mounting assembly to a predetermined position within the passage.

3. The power tool of claim 1, wherein the pin comprises a longitudinal axis about which the second end of the handle can rotate relative to the housing the pin being capable of moving linearly within the passage in a direction perpendicular to the longitudinal axis.

4. The power tool of claim 3, wherein the longitudinal axis extends in a direction substantially perpendicular to a lengthwise vertical plane.

5. The power tool of claim 1, wherein the pin moves linearly in a direction substantially tangential to a circle which is centered on a centre of gravity axis of the tool and located in a lengthwise vertical plane.

6. The power tool of claim 5, wherein the pin can further move linearly towards or away from the centre of gravity axis.

7. The power tool of claim 1, wherein the shape of the cross section of at least part of the passage is oval.

8. The power tool of claim 7, wherein the lengthwise direction of the oval extends in a direction tangential to a circle centered on a centre of gravity and located in a lengthwise vertical plane.

9. The power tool of claim 7, wherein the biasing mechanism of the first mounting assembly biases the pin of the second mounting assembly, at least in a lengthwise direction of the oval, towards the centre of the oval.

10. The power tool of claim 1, wherein the shape of the cross section of at least part of the passage is semi circular.

11. The power tool of claim 10, wherein the part of the passage which comprises a semi-circular cross section comprises a flat wall and a semi-circular wall, the direction of the flat wall extending in a direction substantially tangential to a circle centered on a centre of gravity axis and located in a lengthwise vertical plane.

12. The power tool of claim 10, wherein the biasing mechanism of the first mounting assembly biases the pin of the second mounting assembly against a flat wall towards a center of the flat wall.

13. The power tool of claim 1, wherein the rod of the first mounting assembly moves in the sleeve in a direction which is perpendicular to the direction of movement of the rod when it axially slides in the sleeve when the pin of the second mounting assembly moves within the passage either rotationally or linearly.

14. A power tool comprising:

a housing;

a handle having a first end opposite a second end, the first end being moveably mounted to the housing via a first mounting assembly, and the second end being moveably mounted to the housing via a second mounting assembly, such that the first mounting assembly is located at an opposite end of the handle from the second mounting assembly;

wherein the first mounting assembly comprises:

a first part mounted on the housing and a second part mounted on the first end of the handle, one of the first and second parts comprising a sleeve, the other of the first and second parts comprising a rod mounted in an axially slideable manner in the sleeve to enable the first end of the handle to slide towards or away from the housing; and a biasing mechanism connected between the two parts which biases the first end of the handle away from the housing;

wherein the second mounting assembly comprises:

a third part mounted on the housing and a fourth part mounted on the second end of the handle, one of the third and fourth parts comprising a support, the other of the third and fourth parts comprising a pin located in the support which is capable of being rotated in the support to enable the second end of the handle to rotate relative to the housing and to move linearly in the support to enable the second end of the handle to move linearly relative to the housing;

wherein the support comprises a passage in which the pin is located, the pin being capable of freely moving within the passage either rotationally to enable the second end of the handle to rotate relative to the housing or linearly to enable the second end of the handle to move linearly relative to the housing;

wherein the shape of the cross section of at least part of the passage is oval; and wherein the part of the passage which comprises either an oval or a semi-circular cross section is formed from one or more inserts located within the support.

* * * * *